US011583870B2

(12) United States Patent
Schmidt et al.

(10) Patent No.: US 11,583,870 B2
(45) Date of Patent: Feb. 21, 2023

(54) INJECTION NOZZLE FOR A SPRAY DEVICE AND SPRAY DEVICE

(71) Applicants: Boris Schmidt, Filderstadt (DE); Gabriele Beddies, Reutlingen (DE); Robert Heinkel, Dettingen (DE); Hannes Knupfer, Pfronstetten (DE)

(72) Inventors: Boris Schmidt, Filderstadt (DE); Gabriele Beddies, Reutlingen (DE); Robert Heinkel, Dettingen (DE); Hannes Knupfer, Pfronstetten (DE)

(73) Assignee: Lechler GmbH, Metzingen (DE)

( * ) Notice: Subject to any disclaimer, the term of this patent is extended or adjusted under 35 U.S.C. 154(b) by 337 days.

(21) Appl. No.: 17/011,153

(22) Filed: Sep. 3, 2020

(65) Prior Publication Data

US 2021/0069733 A1 Mar. 11, 2021

(30) Foreign Application Priority Data

Sep. 6, 2019 (DE) ..... 10 2019 213 569.2

(51) Int. Cl.
*B05B 1/06* (2006.01)
*F04F 5/46* (2006.01)
*B01F 25/312* (2022.01)

(52) U.S. Cl.
CPC ..... *B05B 1/06* (2013.01); *B01F 25/31243* (2022.01); *F04F 5/46* (2013.01)

(58) Field of Classification Search
CPC ..... B01F 25/31243; B05B 1/04; B05B 1/06; F04F 5/46
USPC ..... 261/76
See application file for complete search history.

(56) References Cited

U.S. PATENT DOCUMENTS 2,180,259 A * 11/1939 Sargent ..... F04F 5/46 417/159
3,369,735 A * 2/1968 Hoffmeister ..... F16K 51/02 417/174
4,505,431 A 3/1985 Huffman
(Continued)

FOREIGN PATENT DOCUMENTS

DE 4338585 A1 5/1995
DE 102009046992 A1 5/2011
(Continued)

OTHER PUBLICATIONS

European Search Report issued in corresponding European Application No. 20190177.4, with English translation of category of cited documents dated Mar. 16, 2021 (9 pages).
(Continued)

*Primary Examiner* — Charles S Bushey
(74) *Attorney, Agent, or Firm* — Flynn Thiel, P.C.

(57) ABSTRACT

An injection nozzle for a spray device for drawing in a fluid suction medium by a fluid propellant which is under excess pressure and for spraying an admixture of the suction medium and the propellant. The injection nozzle has a nozzle housing, an injection chamber arranged in the nozzle housing, a jet nozzle which opens in the injection chamber for producing a propellant jet which is introduced into the injection chamber, and a fluid suction opening for the fluid suction medium. The fluid suction opening opens in an annular channel which has a flow connection to the injection chamber.

21 Claims, 5 Drawing Sheets

(56) References Cited

U.S. PATENT DOCUMENTS

| | | | | |
|---|---|---|---|---|
| 4,634,560 | A * | 1/1987 | Eckert | B01F 25/312 261/78.2 |
| 5,615,836 | A | 4/1997 | Graef | |
| 6,042,089 | A | 3/2000 | Klein | |
| 6,994,276 | B2 * | 2/2006 | Faye | H01M 8/04007 239/421 |
| 8,807,158 | B2 * | 8/2014 | Harris | B01F 35/56 285/294.1 |
| 8,845,178 | B2 * | 9/2014 | Hanada | B01F 25/31243 137/888 |
| 9,339,022 | B2 | 5/2016 | Buck et al. | |
| 10,704,813 | B2 * | 7/2020 | Lozyniak | F04F 5/46 |
| 2013/0167566 | A1 * | 7/2013 | Alahyari | B05B 1/00 62/401 |
| 2014/0157807 | A1 * | 6/2014 | Cogswell | F25B 41/00 239/408 |
| 2016/0186783 | A1 * | 6/2016 | Nishijima | F04F 5/20 417/198 |
| 2017/0361357 | A1 | 12/2017 | Raasch et al. | |
| 2019/0048830 | A1 * | 2/2019 | Akiyama | F02M 25/08 |
| 2019/0168175 | A1 * | 6/2019 | Baxter | B01F 23/232 |
| 2019/0331373 | A1 * | 10/2019 | Lozyniak | F25B 9/08 |

FOREIGN PATENT DOCUMENTS

| | | | |
|---|---|---|---|
| DE | 102011085899 | A1 | 5/2012 |
| EP | 2883618 | A1 | 6/2015 |
| FR | 2330462 | A2 | 6/1977 |
| GB | 1516568 | | 7/1978 |
| WO | 2016090029 | A1 | 6/2016 |
| WO | 202043499 | A1 | 3/2020 |

OTHER PUBLICATIONS

Office Action of German Patent Office issued in corresponding German Application No. 10 2019 213 569.2 dated Mar. 19, 2020 (6 pages).

* cited by examiner

INJECTION NOZZLE FOR A SPRAY DEVICE AND SPRAY DEVICE

CROSS-REFERENCE TO RELATED APPLICATIONS

This claims priority from German Application No. 10 2019 213 569.2, filed Sep. 6, 2019, the disclosure of which is hereby incorporated by reference in its entirety into this application.

TECHNICAL FIELD

An embodiment of the invention relates to an injection nozzle for an in particular agricultural spray device for drawing in a fluid suction medium by a fluid propellant which is under excess pressure and for spraying an admixture of the suction medium and the propellant, having a nozzle housing, having an injection chamber which is arranged in the nozzle housing, having a jet nozzle which opens in the injection chamber for producing a propellant jet which is introduced into the injection chamber and having a fluid suction opening for the fluid suction medium. An embodiment of the invention also relates to a spray device, in particular for agricultural purposes, for spraying an admixture of a fluid suction medium and a fluid propellant.

BACKGROUND

An injection nozzle and a spray device are intended to be improved with the invention.

SUMMARY

The injection nozzle according to an embodiment of the invention for a spray device is provided for drawing in a fluid suction medium by a fluid propellant which is under excess pressure and for spraying an admixture of the suction medium and the propellant. The injection nozzle has a nozzle housing, an injection chamber which is arranged in the nozzle housing, a jet nozzle which opens in the injection chamber for producing a propellant jet which is introduced into the injection chamber and a fluid suction opening for the fluid suction medium. The fluid suction opening opens in an annular channel which has a flow connection to the injection chamber.

Injection nozzles are known in principle and operate in accordance with the so-called Venturi principle. A fluid jet is introduced into an injection chamber, produces a reduced pressure in the injection chamber and then carries gas or air with it. The so-called water jet pump operates according to this principle.

In the field of plant protection, conventional injection nozzles are problematic since the mixture ratio between drawn-in fluid and carrier fluid changes significantly with the pressure or the quantity of the carrier fluid. However, such a change of the mixture ratio, even only in the case of unintentional pressure fluctuations of the carrier fluid, is extremely problematic in agricultural technology. The injection nozzle according to the invention can also ensure in the event of changing pressure of the supplied propellant a substantially constant mixture ratio between the propellant and the suction medium.

By the fluid suction medium first being introduced into an annular channel which has a flow connection to the injection chamber, a uniform distribution of the suction medium initially in the annular channel and then when introduced into the injection chamber can be ensured. The annular channel may surround the jet nozzle. The flow connection from the annular channel to the injection chamber may be formed by means of a plurality of through-holes which are arranged in a notional concentric circle or in any other appropriate manner. It is advantageous for the suction medium to be introduced into the injection chamber in such a manner that it surrounds the propellant jet discharged from the jet nozzle in a uniform manner.

In a development of the invention, the annular channel is open at one side towards the injection chamber so that the flow connection to the injection chamber is formed by means of an annular gap.

In this manner, the suction medium can be introduced into the injection chamber in the form of an annular jet so that in the injection chamber a uniform mixing between the propellant and the suction medium can be ensured. As a result of the propellant jet which opens in the injection chamber, there is produced a reduced pressure which acts in a region surrounding the propellant jet. When the suction medium is introduced into the injection chamber via an annular gap, the suction medium is drawn in a uniform manner when viewed over the periphery of the injection chamber.

In a development of the invention, the fluid suction opening opens in the annular channel upstream of the outlet opening of the jet nozzle.

The suction medium can thereby initially be distributed in the annular channel in a uniform manner over the periphery of the annular channel so that the suction medium is then also introduced into the injection chamber via the flow connection in a state distributed in a uniform manner around the periphery of the propellant jet.

In a development of the invention, the flow connection from the annular channel to the injection chamber opens in the injection chamber at the height of the outlet opening of the jet nozzle.

Directly after the propellant jet has been discharged from the outlet opening of the jet nozzle into the injection chamber, there is applied a comparatively large reduced pressure. By the flow connection from the annular channel to the injection chamber opening at the height of the outlet opening of the jet nozzle into the injection chamber, a good uniform suction effect can be achieved.

In a development of the invention, the annular channel is delimited at least at one side by a jet nozzle housing of the jet nozzle.

The suction medium thereby flows in the annular channel around a jet nozzle housing and is then introduced, in a manner radially surrounding the jet nozzle housing, as an annular jet into the injection chamber. A very uniform volume distribution of the suction medium around the propellant jet can thereby be achieved and a structurally comparatively simple construction of the injection nozzle can be ensured since the jet nozzle housing acts at the same time as a single-sided delimitation of the annular channel.

In a development of the invention, at least one pin diaphragm is provided in a suction channel upstream of the fluid suction opening.

Using such a pin diaphragm or such a restrictor, or a plurality of pin diaphragms, aperture plates or restrictors which are arranged one behind the other, a quantity of the incoming suction medium can be controlled and a constant ratio between the quantity of propellant and the quantity of suction medium can be ensured, even in the event of pressure fluctuations of the propellant. For example, two pin diaphragms which are arranged one behind the other in the flow direction may be provided in the suction channel. In this instance, the pin diaphragm openings of the pin diaphragms or restrictors do not necessarily have to be arranged in alignment with each other but may also be arranged offset from each other.

In a development of the invention, the nozzle housing is provided with a pin diaphragm insert which has a portion of the suction channel for drawing in the fluid suction medium and the pin diaphragm and which is releasably arranged on the nozzle housing.

By providing a pin diaphragm insert or aperture plate insert which is releasably arranged on the nozzle housing, the injection nozzle according to the invention may be constructed in a modular manner. Depending on what ratio is desired between the propellant and the suction medium, the through-opening of the pin diaphragm can be changed by a pin diaphragm insert with another pin diaphragm being used. If an admixture of plant protection means and water is produced, therefore, by exchanging the pin diaphragm insert the concentration of the plant protection means in the water can be changed. Depending on the requirements placed on the mixture ratio between the plant protection means and water, generally between suction medium and propellant, the restrictor hole, that is to say, the pin diaphragm opening, may have a diameter of from, for example, 0.1 mm to 1.5 mm.

In a development of the invention, the pin diaphragm insert is connected to the nozzle housing by means of a sliding guide. In this manner, the pin diaphragm insert can be connected to the nozzle housing in a very simple manner. For example, the nozzle insert has a connecting piece which can be inserted into a suitable hole of the nozzle housing. The connecting piece may be provided with a peripheral sealing ring in order by means of simple insertion of the pin diaphragm insert to completely form the suction channel and to seal it against the environment. Of course, it is also possible for the nozzle housing to have a connecting piece and for the pin diaphragm insert to have a receiving region. The pin diaphragm insert can be inserted into the nozzle housing by means of the sliding guide and engages automatically in the end position thereof, for example, by means of engagement of sealing rings in appropriate grooves or receiving members in the nozzle housing. In order to release the pin diaphragm insert, there may be provided between the nozzle housing and the pin diaphragm insert, for example, a small recess in which the blade of a screwdriver can be introduced. By simply turning the screwdriver, the pin diaphragm insert is then moved counter to the insertion direction by a small distance in the discharge direction along the sliding guide. This movement caused by the rotation of the screwdriver is then sufficient to release the engagement between the pin diaphragm insert and the nozzle housing. After this engagement has been released, the pin diaphragm insert can be pulled simply by hand and without the additional use of a tool out of the sliding guide.

In a development of the invention, the pin diaphragm insert is releasably arranged on an injector component which has at least the jet nozzle and the injection chamber.

In this manner, the modular construction of the injection nozzle according to the invention can be developed. For different suction media, for example, different injection components can be used. In particular, the injection component with the jet nozzle which can become worn can be replaced in a simple manner. Advantageously, the injector component with the pin diaphragm insert secured thereto is inserted into an outlet nozzle component of the injection nozzle. The injector component can be removed from the outlet nozzle component and only then can the pin diaphragm insert be released from the injector component.

In a development of the invention, the injection chamber downstream of the outlet opening of the jet nozzle has a first conical portion which expands in the flow direction and has a second conical portion which adjoins the first conical portion and which expands in the flow direction, wherein the second conical portion has a larger cone angle than the first conical portion.

As a result of such a configuration of the injection chamber with two sequential conical portions, a mixture ratio between the propellant and suction medium can also be kept substantially constant, even in the event of pressure fluctuations of the propellant.

In a development of the invention, a cone angle of the first conical portion is in the range from 5° to 15°, in particular between 5° and 10°.

In a development of the invention, a cone angle of the second conical portion is in the range from 30° to 40°.

In a development of the invention, the first conical portion has when viewed in the flow direction a length which is in the range from two to four times, in particular three times, the length of the second conical portion.

In a development of the invention, an outlet opening of the jet nozzle opens in a portion of the injection chamber which tapers in a conical manner in the flow direction.

Such an embodiment of the injection chamber contributes to a uniform mixture ratio between propellant and suction medium even in the event of pressure fluctuations of the propellant.

In a development of the invention, a cylindrical portion of the injection chamber is arranged upstream of the first conical portion, wherein the first conical portion adjoins the cylindrical portion.

The provision of such a cylindrical portion upstream of the two conical portions and in particular downstream of the portion which tapers in a conical manner also contributes to a constant mixture ratio between the propellant and suction medium even in the event of pressure fluctuations of the propellant.

In a development of the invention, a ratio between the diameter of the cylindrical portion of the injection chamber and a length of the portion of the injection chamber which tapers in a conical manner in a flow direction between the outlet opening of the jet nozzle and the beginning of the cylindrical portion is in the range from 0.5 to 5, in particular between 1 and 2, in particular 1.4.

In a development of the invention, a ratio between the diameter of the cylindrical portion of the injection chamber and a diameter of the outlet opening of the jet nozzle is in the range from 1 to 3, in particular between 1.5 and 1.7, in particular 1.6.

In a development of the invention, a pin diaphragm is provided in a suction channel upstream of the fluid suction opening, wherein a ratio between the diameter of the cylindrical portion of the injection chamber and a diameter of a through-opening of the pin diaphragm is in the range from 1.5 to 15, in particular between 4 and 6, in particular 4.7.

In a development of the invention, a ratio between a surface-area of the cylindrical portion of the injection chamber and a surface-area of the flow connection from the annular channel to the injection chamber is in the range from 0.25 to 2.5, in particular between 0.5 and 1, in particular 0.76.

In a development of the invention, the flow connection between the annular channel and the injection chamber is arranged in a portion directly upstream of the opening in the injection chamber between two walls which taper in a conical manner in the flow direction.

In this manner, when viewed over the periphery of the annular channel and over the periphery of the injection chamber, constant flow relationships and pressure relationships can be adjusted. For example, the annular channel merges by means of an annular gap into the injection chamber. By this annular gap between the annular channel and the injection chamber tapering in a conical manner in a flow direction, a contribution is made to a constant mixture ratio between the propellant and suction medium, even in the event of pressure fluctuations of the propellant.

The problem forming the basis of the invention is also solved with a spray device for spraying an admixture of a fluid suction medium and a fluid propellant having an injection nozzle according to the invention.

Other features and advantages of the invention will be appreciated from the claims and the following description of preferred embodiments of the invention in connection with the drawings. Individual features of the different embodiments which are illustrated or described can be freely combined. This also applies to the combination of individual features without other individual features, in connection with which they are illustrated.

DETAILED DESCRIPTION

Figure 1:
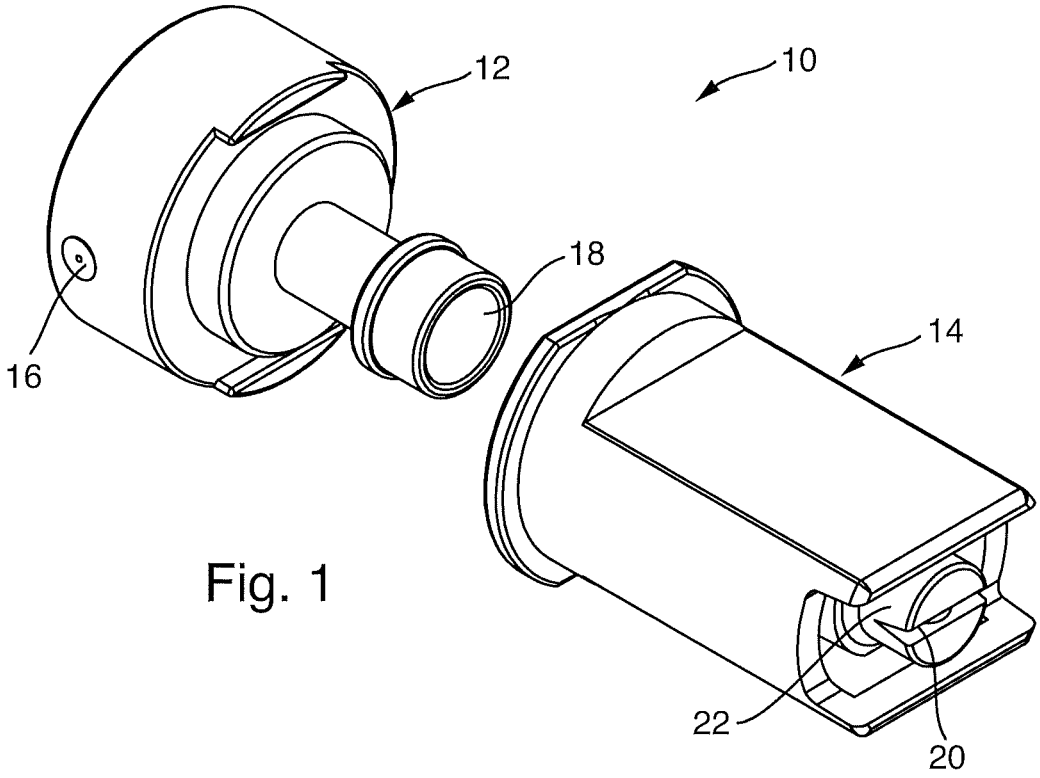
FIG. 1 is an exploded illustration of an injection nozzle according to an embodiment of the invention.
Figure 2:
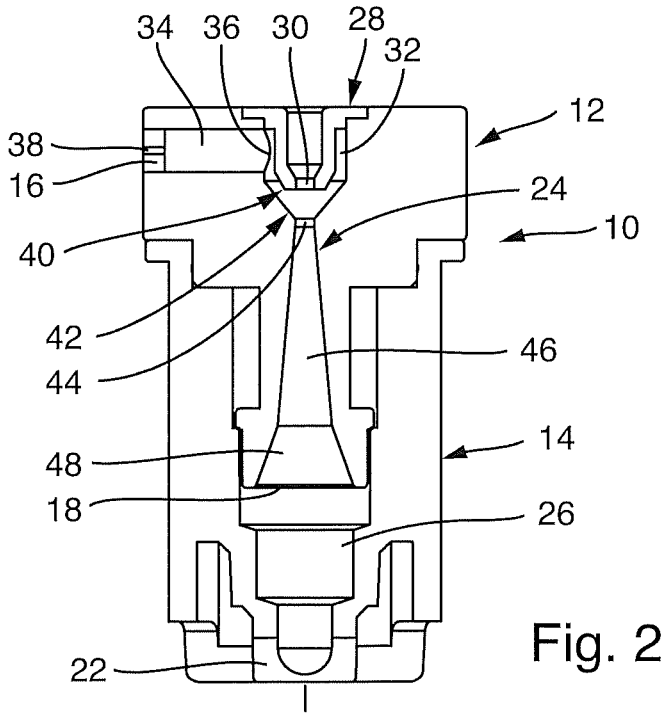
FIG. 2 is a sectioned view of the injection nozzle according to an embodiment of the invention.

FIG. 1 shows an injection nozzle 10 according to an embodiment of the invention in the exploded state. The injection nozzle 10 has an injector component 12 and an outlet nozzle component 14. The injector component 12 is partially inserted into the outlet nozzle component 14 (for example, as shown in FIG. 2) in order to achieve an operational state of the injector nozzle 12. The injection nozzle 12 is then inserted in known manner into a nozzle holder (not illustrated) of a spray device, in particular an agricultural spray device.

A pin diaphragm 16 marks the beginning of a suction channel in the injector component 12. Via the pin diaphragm 16, fluid suction medium is drawn from a storage tank, mixed with a fluid propellant, and an admixture of fluid suction medium and fluid propellant is discharged at an end 18 of an injection chamber 24 located downstream. The admixture then enters the outlet nozzle component 14 (shown in FIG. 2) and is discharged as a flat jet via an outlet opening 20 of a flat jet nozzle 22. In place of the flat jet nozzle 22, of course substantially any outlet nozzle may be provided on the outlet nozzle component 14, for example, a hollow cone nozzle or full cone nozzle.

FIG. 2 is a sectioned view of the injection nozzle 10 of FIG. 1 in the assembled state. The injector component 12 is shown as being partially inserted into the outlet nozzle component 14. At the end 18 of the injection chamber 24, the admixture of fluid suction medium and fluid propellant is introduced into an outlet chamber 26, at the downstream end of which the outlet nozzle 22 is then arranged.

In the injector component 12 there is arranged a jet nozzle housing 28 via which the fluid propellant, which can be pressurized water, is introduced into the injection chamber 24 in the form of a propellant jet. In the embodiment illustrated, the propellant jet is constructed as a full jet and enters the injection chamber 24 via an outlet opening 30 of the jet nozzle housing 28. The outlet opening 30 has a diameter $d_{TR}$.

The jet nozzle housing 28 is surrounded by an annular channel 32. A suction channel 34 opens at a fluid suction opening 36 in the annular channel 32. A left end of the suction channel 34 as illustrated in FIG. 2 is delimited in the illustration of FIG. 2 by the pin diaphragm 16. The pin diaphragm 16 has a through-opening 38 having a diameter $d_R$.

The annular channel 32 is delimited at one side by the jet nozzle housing 28 and is in flow connection with the injection chamber 24. In the embodiment illustrated, the flow connection between the annular channel 32 and the injection chamber 24 is constructed in the form of an annular gap 40. The annular gap 40 is produced by the annular channel 32 being open at one side towards the injection chamber 24. A surface-area of the annular gap 40 at the height of the downstream end of the outlet opening 30 is designated $A_S$. In the context of the illustrated embodiment of the invention, the flow connection between the annular channel 32 and injection chamber 24 may also be constructed differently, for example, by a plurality of channels.

The injection chamber 24 has four portions when viewed in the flow direction.

The outlet opening 30 of the jet nozzle housing 28 and the annular gap 40 open in a portion 42 of the injection chamber 24 which tapers in a conical manner and which is constructed in a generally frustoconical manner. The portion 42 which tapers in a conical manner is adjoined by a cylindrical portion 44. The cylindrical portion 44 is adjoined by a first conically expanding portion 46, which has a first cone angle. The first portion 46 which expands in a conical manner is adjoined by a second conically expanding portion 48 which has a second cone angle. The second cone angle is greater than the first cone angle. The first conically expanding portion 46 is constructed to be longer than the second conically expanding portion 48. A cone angle of the first conical portion is in the range between 5° and 15° and in particular between 5° and 10°. A cone angle of the second conical portion 48 is in the range from 30° to 40°. The first conical portion 46 has, when viewed in the flow direction, a length which is in the range from two times to four times, in particular three times, the length of the second conical portion 48. The two successive conically expanding portions 46, 48 contribute to a constant mixture ratio between the fluid propellant and the fluid suction medium, even in the event of pressure fluctuations of the propellant.

A propellant jet which is produced by the jet nozzle and which is discharged from the outlet opening 30 of the jet nozzle housing 28 is then introduced into the conically tapering portion 42 of the injection chamber 24 and produces by the so-called Venturi effect a reduced pressure in the injection chamber 24. Consequently, the fluid suction medium is drawn via the through-opening 38 of the pin diaphragm 16 into the suction channel 34 and is introduced via the fluid suction opening 36 into the annular channel 32. The suction medium is distributed in the annular channel 32 and then enters, distributed in a uniform manner when viewed over the periphery of the jet nozzle housing 28, the injection chamber 24 through the annular gap 40. In place of the annular gap 40, for example, a plurality of through-channels may also be provided between the annular channel 32 and the injection chamber 24.

The propellant jet enters the cylindrical portion 44 together with the drawn-in suction medium and then the two conically expanding portions 46, 48 of the injection chamber 24. Already in the conically tapering portion 42 of the injection chamber 24, the propellant jet begins to break up and there is produced a mixing between the propellant jet and the drawn-in suction medium. At the end 18 of the injection chamber 24 located downstream, the admixture of the fluid suction medium and the fluid propellant is thereby introduced into the outlet chamber 26. In the outlet chamber, there is brought about further homogenization of the admixture between the fluid propellant and the fluid suction medium. In the embodiment illustrated, a flat jet comprising the admixture of the fluid propellant and the fluid suction medium is then discharged from the outlet nozzle 22. As has been set out, as a result of the special construction of the injection nozzle 10, a constant mixture ratio between the fluid propellant and the fluid suction medium can be ensured, even in the event of pressure fluctuations of the fluid propellant. The injection nozzle 10 according to an embodiment of the invention is thereby particularly suitable for use in agricultural engineering. In the context of an embodiment of the invention, the outlet nozzle 22 may also be constructed as a full cone nozzle or hollow cone nozzle.

Figure 3:
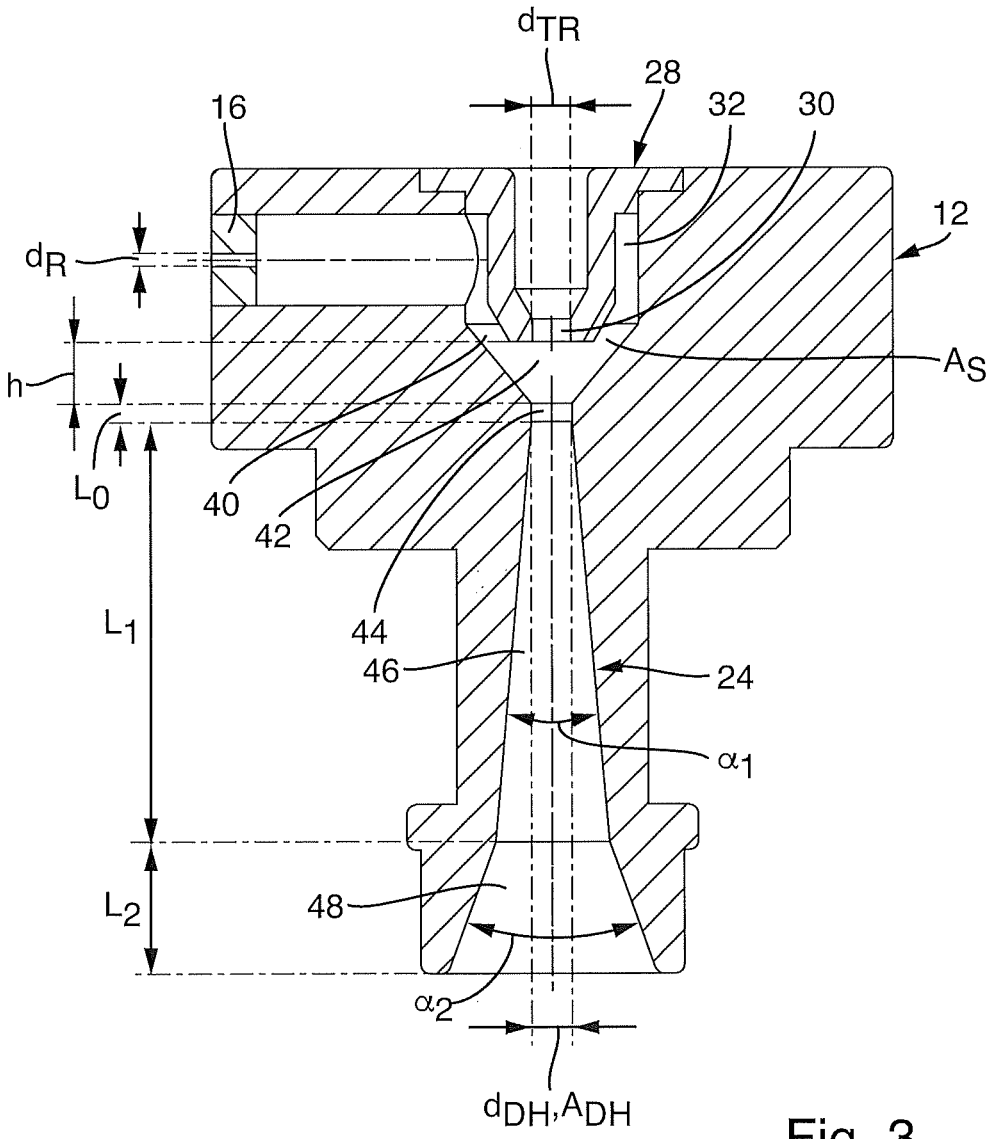
FIG. 3 is an enlarged sectioned view of an injector component of the injection nozzle according to an embodiment of the invention.

FIG. 3 is an enlarged illustration of the injector component 12 of the injection nozzle 10 of FIGS. 1 and 2.

A diameter of the through-opening of the pin diaphragm 16 is designated $d_R$. A diameter of the outlet opening 30 of the jet nozzle housing 28 is designated $d_{TR}$. A length of the portion 42 of the injection chamber 24 which tapers in a conical manner is designated h when viewed in the flow direction. A diameter of the cylindrical portion 44 of the injection chamber 24 is designated $d_{DH}$ and a cross-sectional surface-area of the cylindrical portion 44 is designated $A_{DH}$.

A surface-area of the annular gap 40 at the downstream end of the flow connection between the annular channel 32 and the injection chamber 24 is designated $A_S$. A cone angle of the first conically expanding portion 46 of the injection chamber 24 is designated $\alpha 1$ and a cone angle of the second conically expanding portion 48 of the injection chamber 24 is designated $\alpha 2$. A length of the cylindrical portion 44 of the injection chamber 24 is designated $L_0$. A length of the first conically expanding portion 46 is designated $L_1$ and a length of the second conically expanding portion 48 is designated $L_2$.

$L_0$ is significantly smaller than h and is in the embodiment illustrated only approximately a third of h. $L_1$ and $L_2$ are significantly larger than $L_0$. $L_1$ is larger than $L_2$ and $L_1$ is approximately from twice as large up to four times as large as $L_2$. $\alpha 1$ is in the range from 5° to 15°, in particular between 5° and 10°. $\alpha 2$ is in the range from 30° to 40°.

A ratio $d_{DH}/h$ between the diameter $d_{DH}$ of the cylindrical portion 44 of the injection chamber 24 and the length h of the portion 42 of the injection chamber 24 which tapers in a conical manner in the flow direction between the outlet opening 30 and the beginning of the cylindrical portion 44 is in the range from 0.5 to 5, in particular between 1 and 2, in particular 1.4.

A ratio $d_{DH}/d_{TR}$ between the diameter $d_{DH}$ of the cylindrical portion 44 of the injection chamber and a diameter $d_{TR}$ of the outlet opening 30 of the jet nozzle is in the range from 1 to 3, in particular between 1.5 and 1.7, in particular 1.6.

A ratio $d_{DH}/d_R$ between the diameter $d_{DH}$ of the cylindrical portion 44 of the injection chamber 24 and a diameter $d_R$ of a through-opening of the pin diaphragm 16 is in the range from 1.5 to 15, in particular between 4 and 6, in particular 4.7.

A ratio $A_{DH}/A_S$ between a surface-area $A_{DH}$ of the cylindrical portion 44 of the injection chamber 24 and a surface-area $A_S$ of the flow connection from the annular channel 32 to the injection chamber 24, in particular a surface-area $A_S$ of the annular gap 40, is in the range from 0.25 to 2.5, in particular between 0.5 and 1, in particular 0.76.

The above-explained relationships and also the above-explained lengths and diameters and angles contribute to a constant mixture ratio between the fluid suction medium and the fluid propellant, even in the event of pressure fluctuations of the fluid propellant. The injection nozzle according to an embodiment of the invention is thereby particularly suitable for use in agricultural engineering.

Figure 4:
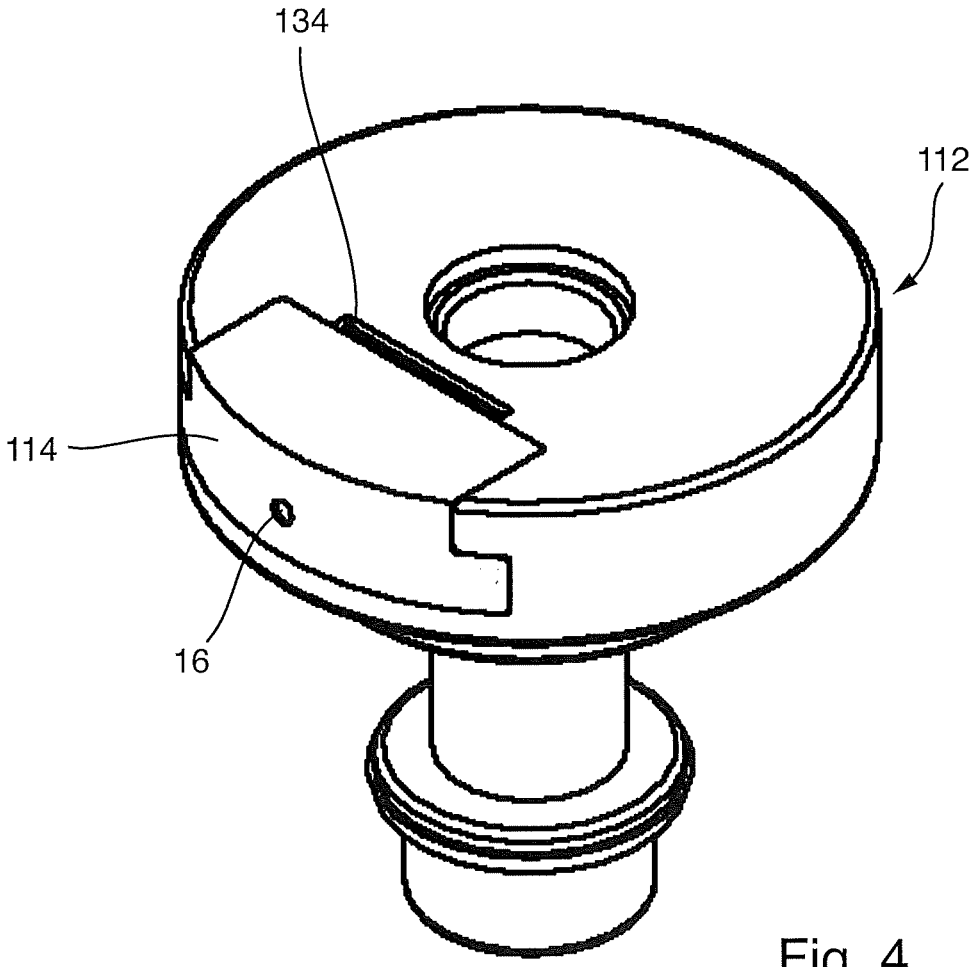
FIG. 4 is a view of an injector component according to another embodiment of the invention.

FIG. 4 shows an injector component 112 according to another embodiment of the invention. The injector component 112 is constructed in a very similar manner to the injector component 12 of FIGS. 1 to 3 so that identical elements are either not explained or indicated with the same reference numerals. The injector component 112 may be inserted into the outlet nozzle component 14 illustrated in FIGS. 1 to 3 in place of the injector component 12 of FIGS. 1 to 3.

The injector component 112 has a modular pin diaphragm insert 114. The modular pin diaphragm insert 114 has the pin diaphragm or aperture plate 16 and a portion of the suction channel. The suction channel is then continued into the injector component 112.

Figure 5:
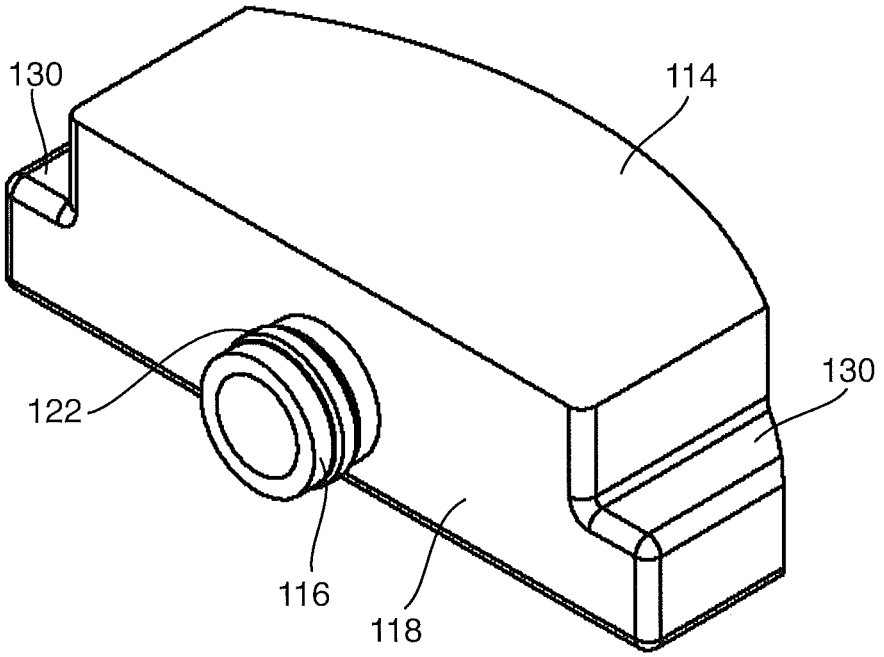
FIG. 5 is a pin diaphragm insert for the injector component of FIG. 4.
Figure 6:
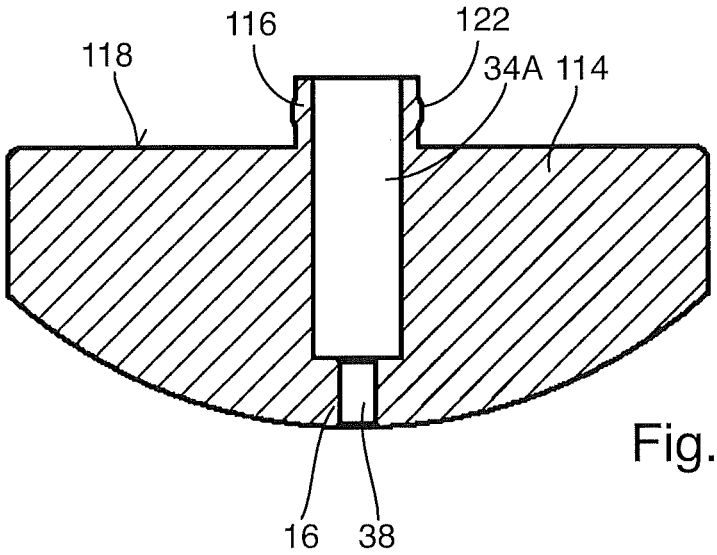
FIG. 6 is a sectioned view of the pin diaphragm insert of FIG. 5.

FIG. 5 shows the pin diaphragm insert 114 obliquely from below and FIG. 6 shows the pin diaphragm insert 114 as a sectioned view. FIG. 6 shows that the pin diaphragm insert 114 defines a portion 34A of the suction channel. However, the remaining portion 34B of the suction channel which then leads to the annular channel around the jet nozzle (see FIG. 2), is formed in the injector component 112.

The pin diaphragm insert 114 has at the upstream end of the suction channel 34A thereof the pin diaphragm 16 which defines the restrictor hole 38. Depending on the flow resistance of the restrictor hole 38, that is to say, depending on the diameter of the restrictor hole 38 and depending on the length of the restrictor hole 38, the flow resistance of the restrictor hole 38 changes and consequently a ratio between the quantity of suction medium drawn in and the quantity of the fluid propellant can be adjusted.

Figure 7:
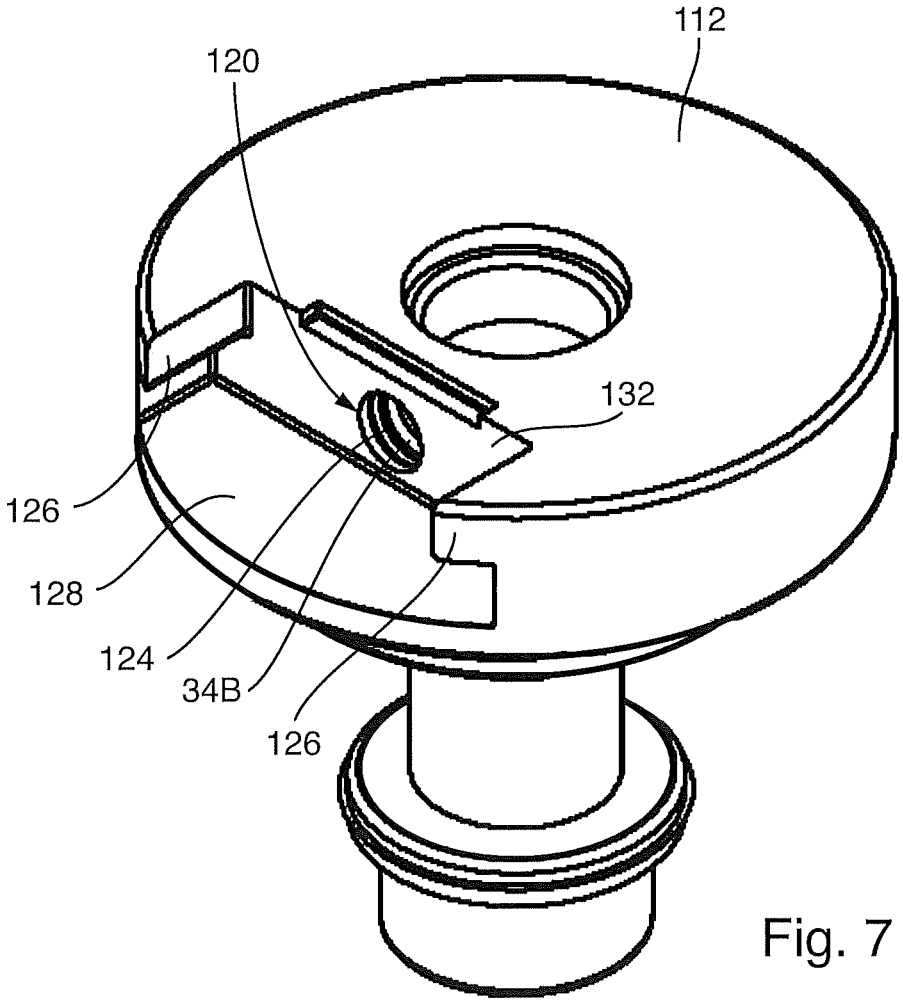
FIG. 7 shows the injector component of FIG. 4 without the pin diaphragm insert.

FIG. 5 shows that the portion 34A of the suction channel is formed at the downstream end thereof by a connecting piece 116 which protrudes over a stop face 118 of the pin diaphragm insert 114. The connecting piece 116 is provided (see FIG. 7) to be inserted into an appropriate recess 120 in the injector component 112. By simply inserting the pin diaphragm insert 114 into the sliding guide of the injector component 112, wherein at the end of the sliding movement the pin 116 is introduced into the recess 120, on the one hand, the portion 34A is tightly connected to the portion 34B of the suction channel. This is achieved by the connecting piece 116 being provided with a peripheral projection 122 which can engage in an appropriate peripheral groove 124 in the recess 120. For example, the peripheral projection 122 is formed by a sealing ring so that, after the engagement of the projection 122 in the groove 124, the two portions 34A, 34B of the suction channel are connected tightly to each other. Only small demands are placed on the fluid-tightness of this connection since the suction channel 34 and consequently also the connection of the portions 34A, 34B is under reduced pressure during operation of the injection nozzle.

The projection 122, which in the assembled state of the pin diaphragm insert 114 is engaged in the groove 124, also ensures mechanical securing of the pin diaphragm insert 114 on the injector component 112.

The sliding guide is formed on the injector component 112 by two strip-like projections 126 which protrude into a recess on the injector component 112 which extends as far as the edge of the injector component. An undercut is thereby formed at both sides between the strip-like projections 126 and a base 128 of the recess.

The pin diaphragm insert 114 also has at both sides strip-like projections 130 which are adapted to the length, height and width of the undercut in the recess. By simply pushing the strip-like projections 130 into the undercuts on the injector component 112, the pin diaphragm insert is thereby guided on the injector component 112. The pin diaphragm insert 114 can be inserted along the sliding guide into the injector component 112 until the end face 118 of the pin diaphragm insert 114 strikes the end-side delimitation 132 of the recess in the injector component 112. This state is illustrated in FIG. 4. As soon as the pin diaphragm insert 114 has reached the end position thereof illustrated in FIG. 4, the projection 122 on the connecting piece 116 of the pin diaphragm insert 114 is also engaged in the groove 124 in the recess 120 of the injector component 112.

In order to be able to change the pin diaphragm insert 114, that is to say, to be able to remove it from the position illustrated in FIG. 4, the edge of a coin or the blade of a screwdriver is introduced into a rectangular recess 134 at the upper side of the injector component 112. A delimitation of this recess 134 forms the end face 118 of the pin diaphragm insert 114. By turning the coin or the blade of the screwdriver, the pin diaphragm insert 114 can thereby be moved a small distance along the sliding guide in a radial direction away from the injector component 112. This movement has to be carried out only until the peripheral projection 122 on the connecting piece 116 of the pin diaphragm insert 114 has been moved out of the groove 124 of the recess 120 in the injector component 112. The locking connection between the pin diaphragm insert 114 and the injector component 112 is thereby released. The pin diaphragm insert 114 can then be readily removed from the injector component 112 by hand along the sliding guide. The pin diaphragm insert 114 can then, for example, be replaced with another pin diaphragm insert which differs from the pin diaphragm insert 114 only in terms of another dimension of the restrictor hole 38 of the pin diaphragm 16. In this manner, the injection nozzle according to an embodiment of the invention can be adapted in a simple manner so that different relationships of the quantity of suction medium and the quantity of propellant can be adjusted.

The invention claimed is:

1. An injection nozzle for a spray device for drawing in a fluid suction medium by a fluid propellant which is under excess pressure and for spraying an admixture of the fluid suction medium and the fluid propellant, the injection nozzle comprising a nozzle housing having an injection chamber which is arranged in the nozzle housing, a jet nozzle which opens in the injection chamber for producing a propellant jet which is introduced into the injection chamber, and a fluid suction opening for the fluid suction medium, wherein the fluid suction opening opens in an annular channel which has a flow connection to the injection chamber, and wherein at least one pin diaphragm is provided in a suction channel upstream of the fluid suction opening.

2. The injection nozzle according to claim 1, wherein the annular channel is open at one side towards the injection chamber so that the flow connection to the injection chamber is formed by means of an annular gap.

3. The injection nozzle according to claim 1, wherein the fluid suction opening opens in the annular channel upstream of an outlet opening of the jet nozzle.

4. The injection nozzle according to claim 1, wherein the flow connection from the annular channel to the injection chamber opens in the injection chamber at the height of an outlet opening of the jet nozzle.

5. The injection nozzle according to claim 1, wherein the annular channel is delimited at least at one side by a jet nozzle housing of the jet nozzle.

6. The injection nozzle according to claim 1, wherein the nozzle housing is provided with a pin diaphragm insert which has a portion of the suction channel for drawing in the fluid suction medium and the pin diaphragm and which is releasably arranged on the nozzle housing.

7. The injection nozzle according to claim 6, wherein the pin diaphragm insert is connected to the nozzle housing by a sliding guide.

8. The injection nozzle according to claim 6, wherein the pin diaphragm insert is releasably arranged on an injector component which has at least the jet nozzle and the injection chamber.

9. The injection nozzle according to claim 1, wherein the injection chamber downstream of an outlet opening of the jet nozzle has a first conical portion which expands in the flow direction and has a second conical portion which adjoins the first conical portion and which expands in the flow direction, wherein the second conical portion has a larger cone angle than the first conical portion.

10. The injection nozzle according to claim 9, wherein a cone angle of the first conical portion is in the range from 5° to 15°.

11. The injection nozzle according to claim 9, wherein a cone angle of the second conical portion is in the range from 30° to 40°.

12. The injection nozzle according to claim 9, wherein the first conical portion has when viewed in the flow direction a length which is in the range from two to four times the length of the second conical portion.

13. The injection nozzle according to claim 1, wherein an outlet opening of the jet nozzle opens in a portion of the injection chamber which tapers in a conical manner in the flow direction.

14. The injection nozzle according to claim 13, wherein a ratio between a diameter of a cylindrical portion of the injection chamber and a length of the portion of the injection chamber which tapers in a conical manner in a flow direction between the outlet opening of the jet nozzle and the beginning of the cylindrical portion is in the range from 0.5 to 5.

15. The injection nozzle according to claim 1, wherein a cylindrical portion of the injection chamber is arranged upstream of a first conical portion, wherein the first conical portion adjoins the cylindrical portion.

16. The injection nozzle according to claim 15, wherein a ratio between a surface-area of the cylindrical portion of the injection chamber and a surface-area of the flow connection from the annular channel to the injection chamber is in the range from 0.25 to 2.5.

17. The injection nozzle according to claim 1, wherein the flow connection between the annular channel and the injection chamber is arranged in a portion directly upstream of an opening in the injection chamber between two walls which taper in a conical manner in the flow direction.

18. A spray device for spraying an admixture of a fluid suction medium and a fluid propellant, including at least one injection nozzle according to claim 1.

19. An injection nozzle for a spray device for drawing in a fluid suction medium by a fluid propellant which is under excess pressure and for spraying an admixture of the fluid suction medium and the fluid propellant, the injection nozzle comprising a nozzle housing having an injection chamber which is arranged in the nozzle housing, a jet nozzle which opens in the injection chamber for producing a propellant jet which is introduced into the injection chamber, and a fluid suction opening for the fluid suction medium, wherein the fluid suction opening opens in an annular channel which has a flow connection to the injection chamber, wherein a cylindrical portion of the injection chamber is arranged upstream of a first conical portion, wherein the first conical portion adjoins the cylindrical portion, wherein a pin diaphragm is provided in a suction channel upstream of the fluid suction opening, and wherein a ratio between a diameter of the cylindrical portion of the injection chamber and a diameter of a through-opening of the pin diaphragm is in the range from 1.5 to 15.

20. The injection nozzle according to claim 19, wherein the ratio between the diameter of the cylindrical portion of the injection chamber and a diameter of an outlet opening of the jet nozzle is in the range from 1 to 3.

21. An injection nozzle for a spray device for drawing in a fluid suction medium by a fluid propellant and for spraying an admixture of the fluid suction medium and the fluid propellant, the injection nozzle comprising:

a nozzle housing having an injection chamber within the nozzle housing;

a jet nozzle that opens into the injection chamber for producing a propellant jet introduced into the injection chamber; and a fluid suction opening configured to receive the fluid suction medium;

wherein the fluid suction opening opens into an annular channel fluidly connected to the injection chamber; and wherein at least one pin diaphragm is provided in a suction channel upstream of the fluid suction opening.

* * * * *